US006595726B1

(12) United States Patent
Egan et al.

(10) Patent No.: US 6,595,726 B1
(45) Date of Patent: Jul. 22, 2003

(54) RETAINING WALL SYSTEM AND METHOD OF MAKING RETAINING WALL

(75) Inventors: Philip D. Egan, Atlanta, GA (US); Robert Anderson, Alpharetta, GA (US)

(73) Assignee: Atlantech International, Inc., Atlanta, GA (US)

( * ) Notice: Subject to any disclaimer, the term of this patent is extended or adjusted under 35 U.S.C. 154(b) by 0 days.

(21) Appl. No.: 10/043,159

(22) Filed: Jan. 14, 2002

(51) Int. Cl.[7] ..... E02D 17/00; E02D 29/00; E02D 3/02; E02D 5/00

(52) U.S. Cl. ..... 405/284; 405/262

(58) Field of Search ..... 405/262, 284, 405/286

(56) References Cited

U.S. PATENT DOCUMENTS

| | | | | |
|---|---|---|---|---|
| 4,117,686 A | | 10/1978 | Hilfiker | |
| 4,374,798 A | | 2/1983 | Mercer | |
| 4,505,621 A | | 3/1985 | Hilfiker et al. | |
| 4,530,622 A | | 7/1985 | Mercer | |
| 4,643,618 A | | 2/1987 | Hilfiker et al. | |
| 4,728,227 A | | 3/1988 | Wilson et al. | |
| 4,856,939 A | | 8/1989 | Hilfiker | |
| 4,929,125 A | | 5/1990 | Hilfiker | |
| 5,722,799 A | * | 3/1998 | Hilfiker | 405/282 |
| 5,975,810 A | * | 11/1999 | Taylor et al. | 405/262 |
| 6,287,054 B1 | * | 9/2001 | Egan et al. | 405/262 |
| 6,345,934 B1 | * | 2/2002 | Jailloux et al. | 405/262 |

FOREIGN PATENT DOCUMENTS

| | | |
|---|---|---|
| CH | 666 510 | 7/1988 |
| EP | 0 197 000 | 10/1986 |

* cited by examiner

*Primary Examiner*—Heather Shackelford
*Assistant Examiner*—Lisa M. Saldano
(74) *Attorney, Agent, or Firm*—Jacobson Holman PLLC

(57) ABSTRACT

A retaining wall system formed from a wire facing unit having an upstanding face section and a rearwardly extending floor section the rear end of which is provided with aligned, transversely extending, openings defined by upstanding, inserted U-shaped, in the wire elements. The apertures in the forward portion of a geogrid, preferably an integral, uniaxially-stretched, polymer geogrid, can be seated over the protuberances and a connecting rod inserted through the openings to secure the geogrid to the wire facing unit. Strengthening struts can be engaged between cross-wires at the top of the face section of the wire facing unit and at the rear of the floor section of the wire facing unit. An aggregate, including soil or the like, can then be placed behind the face section and over the floor section of the wire facing unit and over the geogrid to form a geogrid-reinforced retaining wall section. Multiple sections may be formed side-by-side and multiple tiers can be constructed with the front faces of superior sections aligned or set back from each other to permit plantings to be placed in front of superior face sections. The connecting rod may be rigid. Alternatively, the connecting rod may be resilient or flexible to facilitate inserting the same between a pair of wires into the aligned openings formed by the protuberances, particularly for interior wire facing units in a series of laterally juxtaposed sections where access to the openings from the sides of the wire facing unit is difficult.

41 Claims, 6 Drawing Sheets

RETAINING WALL SYSTEM AND METHOD OF MAKING RETAINING WALL

BACKGROUND OF THE INVENTION

1. Field of the Invention

This invention relates to geogrid-reinforced retaining walls, the assembly of parts from which such retaining walls are made, and methods of constructing a retaining wall from such elements, and relates more particularly to reinforced earthen retaining walls wherein the face of the retaining wall is formed by a vertically extending section of a wire facing unit having an integral horizontally extending floor to the rear of which a polymer geogrid is secured in a unique manner to reinforce fill material, such as aggregate, including soil or the like, placed behind the wire facing unit and over the geogrid.

2. Description of the Related Art

The use of welded wire facing units in the construction of retaining walls is well known as is the use of polymer geogrids to reinforce such earthen formations. U.S. Pat. No. 4,856,939 (hereinafter referred to as "the '939 patent"), the subject matter of which is incorporated herein in its entirety by reference, discloses the construction of a geogrid-reinforced earthen retaining wall incorporating welded wire facing units wherein the upper portions of the face sections of the wire facing units include kinks or hooks which serve, inter alia, to retain the ends of polymer geogrids, the remainder of the geogrids being designed to extend downwardly and rearwardly into the fill to reinforce the wall.

Polymer geogrids, particularly uniaxially stretched integral polymer geogrids of the type preferred for use in the construction of such retaining walls, may be made by the process disclosed in U.S. Pat. No. 4,374,798 (hereinafter referred to as "the '798 patent"), the subject matter of which is also incorporated herein in its entirety by reference. Such materials are relatively stiff and can be difficult to engage with the hooked formations in the manner proposed in the '939 patent.

Moreover, although the '939 patent shows the geogrid extending downwardly behind the face section of the wire facing unit and then rearwardly along the top of the floor section of the wire facing unit into the fill material, such sharp bends in the geogrid tend to weaken the strands and, in any event, oftentimes the geogrids do not bend so readily and simply extend rearwardly directly from the point where they engage the hook elements at the top of the face section of the wire facing unit, rather than the proposed arrangement where they extend rearwardly from the rear of the floor section of the wire facing unit.

Finally, attaching the geogrid to the top of the face section of the wire facing unit as taught in the '939 patent is inefficient and costly, especially the portion of the geogrid designed to extend downwardly behind the face section of the wire facing unit adding little to the strength of the earthen formation since the geogrid is primarily intended to reinforce the large volume of fill extending behind the wire facing unit.

SUMMARY OF THE INVENTION

A primary object of this invention is to provide a retaining wall system comprising, in combination, an assembly of elements, including a wire facing unit and a geogrid, with a unique interconnection between these elements which overcomes the foregoing and other such disadvantages in prior art systems.

A further object of this invention is the provision of a retaining wall system wherein the rear end portions of the floor section of the wire facing unit are interengaged at or near the forward end portions of a geogrid section in a manner that avoids the need to bend the geogrid, minimizes the amount of geogrid required, and ensures that the geogrid extends into the fill at a level that is most effective in reinforcing the retaining wall.

Yet another object of this invention is the provision of a wire facing unit wherein the wire elements forming the rear end portions of the floor section are bent into generally inverted U-shaped protuberances which define aligned openings extending generally transversely of the floor section of the wire facing unit. The wire elements forming the protuberances are spaced apart by a distance equal to, or a multiple of, the spacing between the apertures defined in the forward end portion of the geogrid so that the geogrid can be laid over the rear end of the floor section of a wire facing unit with the geogrid apertures overlying the upstanding protuberances. A connector rod can then be inserted through the aligned openings formed by the protuberances to secure the geogrid directly to the rear end of the floor section of the wire facing unit.

Another object of this invention is to provide an assembly of elements of the type described wherein the connector rod is somewhat flexible or resilient to facilitate insertion of the rod into the aligned openings in the floor sections of a wire facing unit between the wires forming the protuberances when the sides of the facing unit are not readily accessible as when the facing unit is located intermediate other facing units in the construction of an elongated retaining wall and the facing unit cannot be lifted up for access to the side because of an obstruction or when the geogrid extends over the floor section of more than one wire facing unit.

A still further object of this invention is to provide an assembly of elements, and a method of using the elements to easily and inexpensively form a reinforced retaining wall section, requiring the use of no extraneous materials or tools, and providing a secure engagement between the wire facing unit forming the face section of the wall and the geogrid reinforcing the fill material behind the wall.

Other and further objects of this invention will be readily understood by those with ordinary skill in the art with particular reference to the following detailed description of the preferred embodiments in combination with the accompanying drawings.

BRIEF DESCRIPTION OF THE DRAWINGS

Like reference characters refer to like parts throughout the several views of the drawings.

DETAILED DESCRIPTION OF THE PREFERRED EMBODIMENTS

Figure 1:
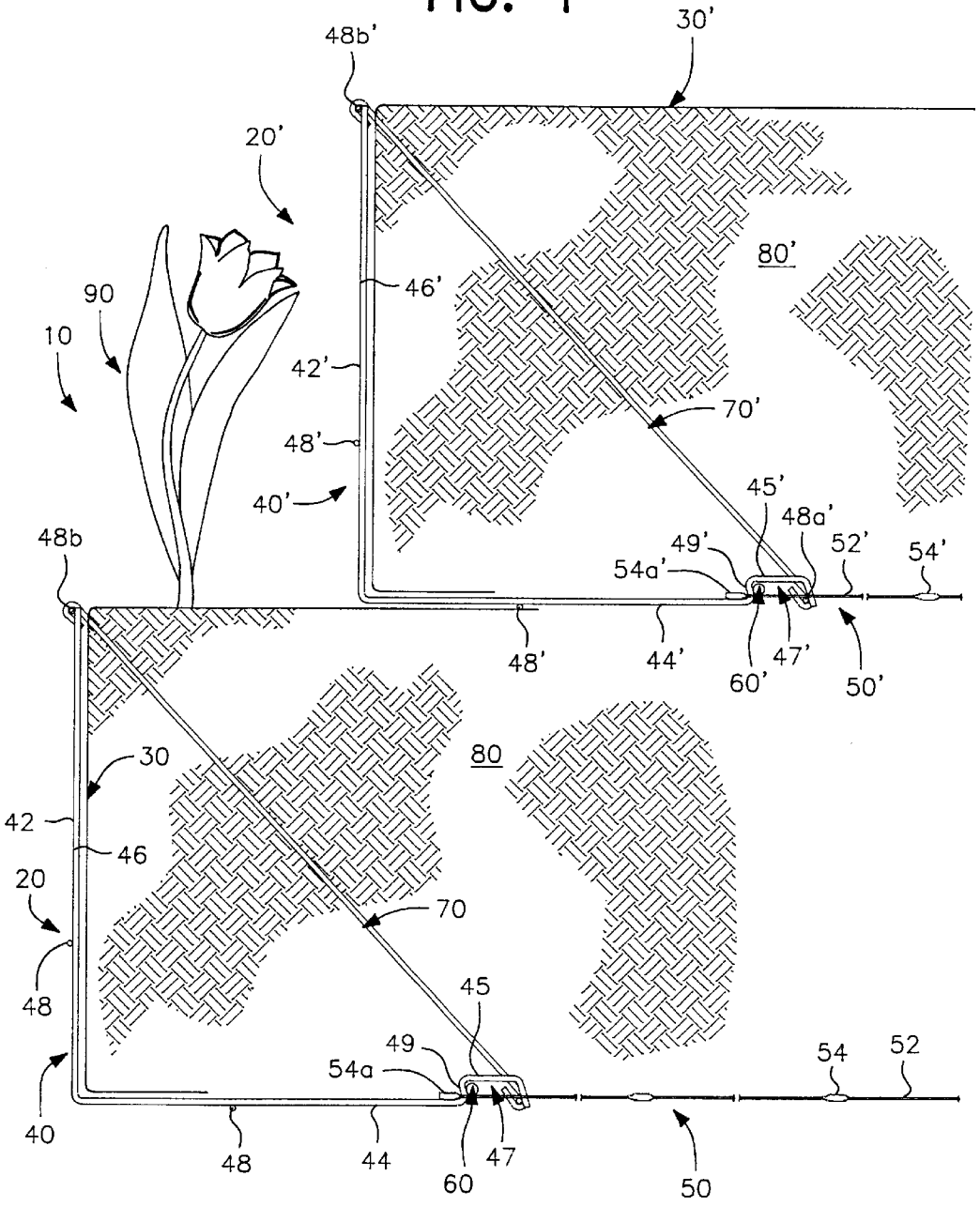
FIG. 1 is a schematic side elevational view of a portion of a geogrid reinforced retaining wall having superimposed wire facing units with the front face of the superior facing unit offset rearwardly from the front face of the facing unit therebelow to provide access to the fill for plantings.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

A retaining wall constructed using the system of the instant invention is designated generally by the reference numeral 10 in FIG. 1, and is shown in this Figure as including two tiers or layers 20, 20' of geogrid-reinforced wall sections, each of which has been constructed of the elements and according to the method of the instant invention. Of course, although two tiers 20, 20' are illustrated in FIG. 1, a retaining wall can be built of only a single tier, or many more than two tiers, depending on the height of the wall and the dimensions of the elements forming the wall. Not only can the height be variable, but the width of the wall can likewise be variable by providing wire facing units and geogrid sections of different dimensions or by associating a multiplicity of laterally juxtaposed assemblies of geogrid-reinforced wire facing units 20*a*, 20*b*, 20*c*, etc., as discussed below with particular reference to FIGS. 6 and 7.

Each of the sections of the retaining wall 10 are formed from an assembly of elements including a wire facing unit 40, one or more sections of geogrid 50, a connecting rod 60, one or more wire struts 70 and a body of fill material 80, such as aggregate, including soil, or the like.

The wire facing unit 40 is commonly formed of metal with a face section 42, and a floor section 44, formed by continuous longitudinally extending wire elements 46, bent generally at a right angle and interconnected by a plurality of spaced, transversely extending, welded cross-wires 48, several of which are shown as illustrative.

The geogrid section 50 can have any width and any length, and can be formed using any well-known prior art technology, including weaving, knitting, or other techniques for securing strands or straps to each other to form a grid-like construction. Preferably, however, the geogrid sections are formed as an integral, uniaxially-stretched, polymer geogrids in accordance with the teachings of the '798 patent referenced hereinabove. Regardless of the method of forming the geogrid, it will include a plurality of spaced, generally parallel, strand elements such as shown at 52, interconnected by generally transversely extending cross-bars 54 or other strands which together define a multiplicity of through-apertures 56. Moreover, according to a preferred embodiment of this invention, the width of a geogrid section 50 is equal to, or an even fraction of, the width of a wire facing unit 40 so as to facilitate construction of a retaining wall according to this invention as discussed below with particular reference to FIG. 6. However, geogrid sections smaller or larger than the width of a facing unit or a non-even fraction of the width of a facing unit can be used without departing from the instant inventive concepts.

Figure 5:
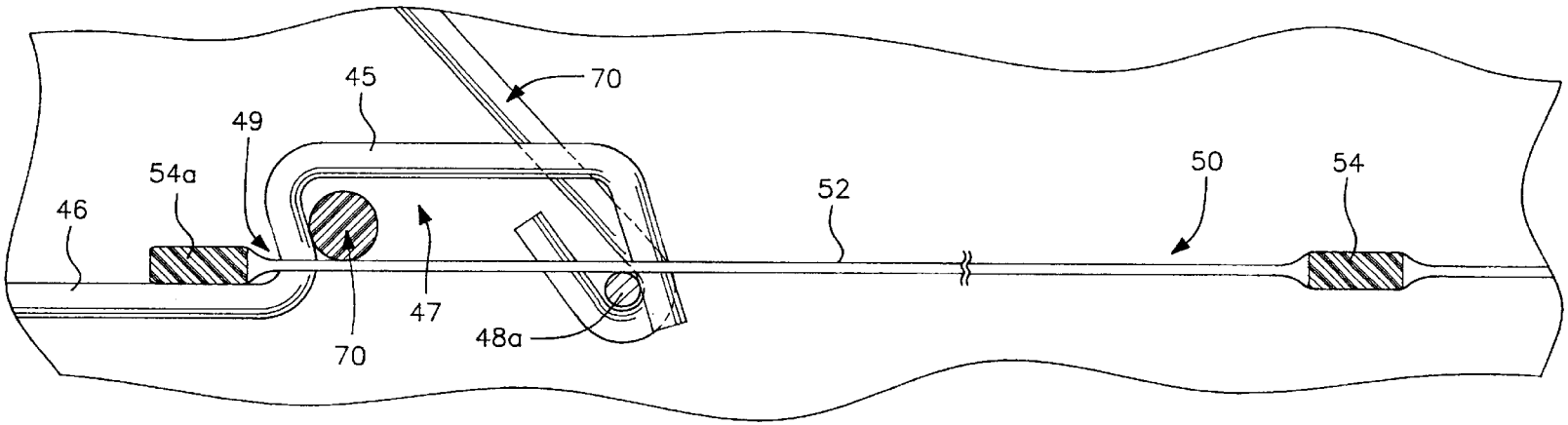
FIG. 5 is an enlarged elevational detail illustrating the engagement of the other end of the wire strut with a cross-wire at the rear end of the floor section of the wire facing unit.

At the rear end portions of the floor section 44 of the wire facing unit 40 of this invention, the longitudinally extending wire elements 46 are bent to form upstanding, generally U-shaped, protuberances 45 extending from the upper face of the floor section 44 to define generally aligned openings 47 extending generally transversely of the floor section 44 of the wire facing unit 40. The portions of the wire elements 46 forming the protuberances may be tilted forwardly as seen best in FIGS. 3, 5 and 7 to form an inclined shoulder or pocket 49 to more securely engage a geogrid section 50 as described below.

In constructing a geogrid-reinforced retaining wall section according to this invention, a wire facing unit 40 is positioned as seen, for example, in FIG. 1, with the front of the face section 42 forming a portion of the face of the retaining wall 10, and the floor section 44 extending rearwardly therefrom. The apertures 56 in the forward end portions of one or more geogrid sections 50 are then positioned over the protuberances 45 at the rear end portions of the floor section 44 of the wire facing unit 40, with at least one of the cross-bars 54*a* of a geogrid section 50 forwardly of the protuberances 45 and seated in the pocket 49, at least one of the generally transversely extending cross-wires 48*a* of the floor section 46 of the wire facing unit 40 underlying the forward end portions of the geogrid section 50, and the remainder of the geogrid section 50 extending rearwardly from the wire facing unit 40.

The ends of one or more struts 70 may then be connected to the cross wires 48*a* and 48*b* of the wire facing unit 40, and a connecting rod 60, preferably having one or more non-flat or rounded ends 62, 64, is inserted through the openings 47 formed by the protuberances 45 to connect the geogrid section 50 to the wire facing unit 40.

If desired, an erosion blanket 30 of conventional construction may be placed inside the wire facing unit 40, and aggregate 80, such as soil or the like, is then filled behind the rear face of the face section 42, on top of the upper face of the floor section 44 of the wire facing unit 40, and over the geogrid section 50.

A further tier or layer of geogrid-reinforced retaining wall such as shown 20' in FIG. 1 can then be constructed on top of the initial tier 20 with the front of the face section 42 of superior wire facing unit 40' positioned rearwardly from the front of the face section 42 of the wire facing unit 40 to form a stepped-back retaining wall as seen in FIG. 1.

Obviously, if desired, the superior sections can be positioned directly above the inferior sections to form a retaining wall with a continuous, generally vertical, face (not shown), rather than a stepped-back face, but the stepped-back arrangement enhances the stability of the face of the retaining wall and enables the incorporation of plantings such as illustrated at 90 in front of upper face sections for erosion control and improved aesthetics.

Figure 3:
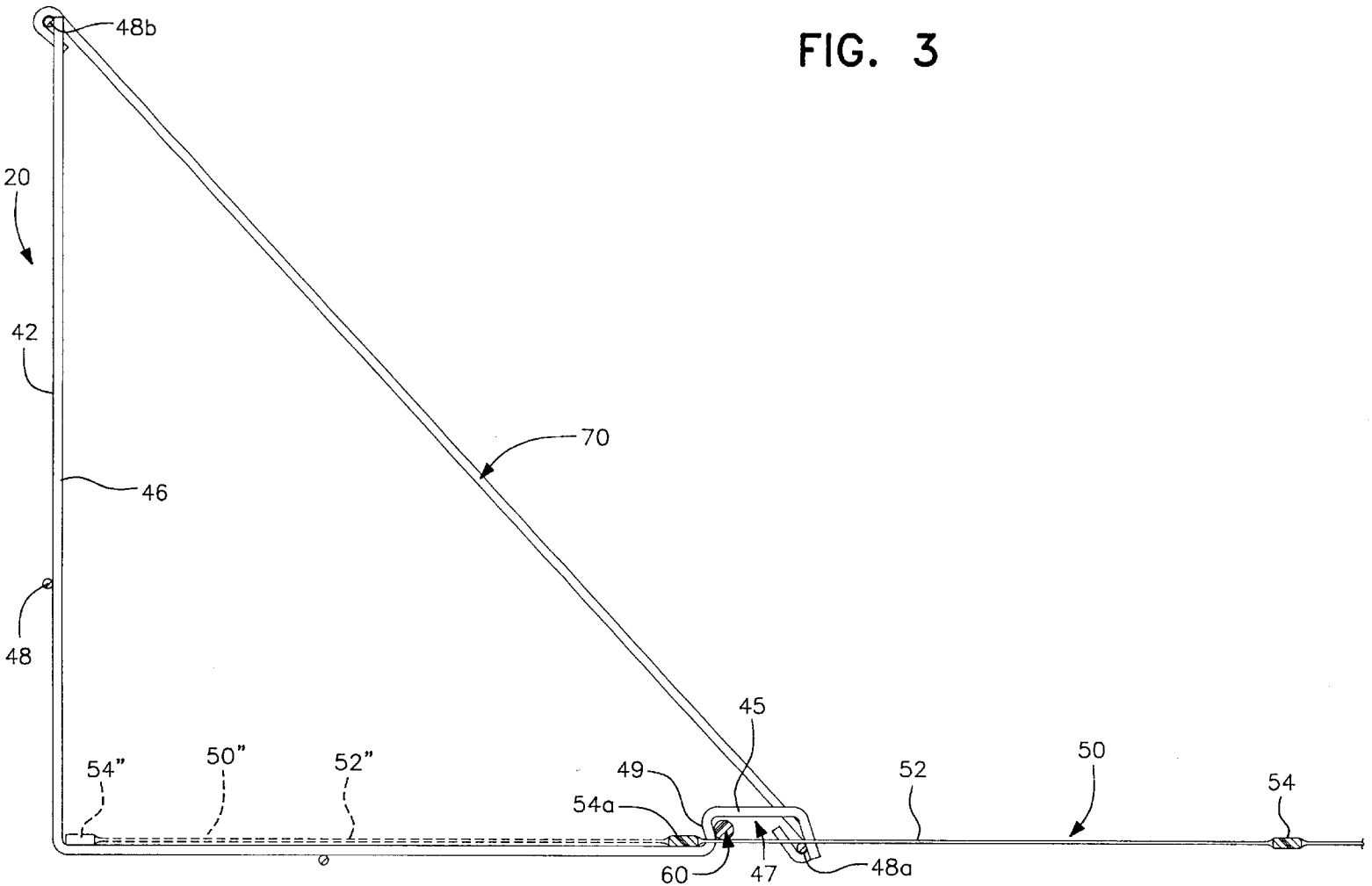
FIG. 3 is a transverse cross-sectional view taken along lines 3—3 of FIG. 2, an alternative or optional connection between the geogrid section and the wire tray facing unit being illustrated in dotted lines.
Figure 4:
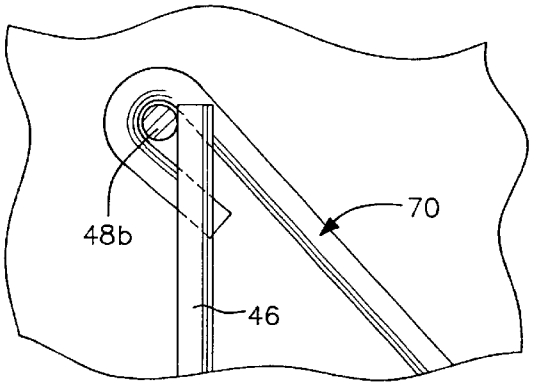
FIG. 4 shows an enlarged elevational detail illustrating the engagement of one end of a wire strut with a cross-wire at the upper end of the face section of a wire facing unit.

While the end cross-bar 54*a* of a geogrid section 50 can be seated in the pocket 49 as seen in solid lines of FIG. 3, a portion 50" of the geogrid section 50 can extend forwardly over the floor section 48 of the wire facing unit 40 as seen in dotted lines in FIG. 3 so that the second (or other) cross-bar 54 of the geogrid section 50 is seated in the pocket 49.

Figure 6:
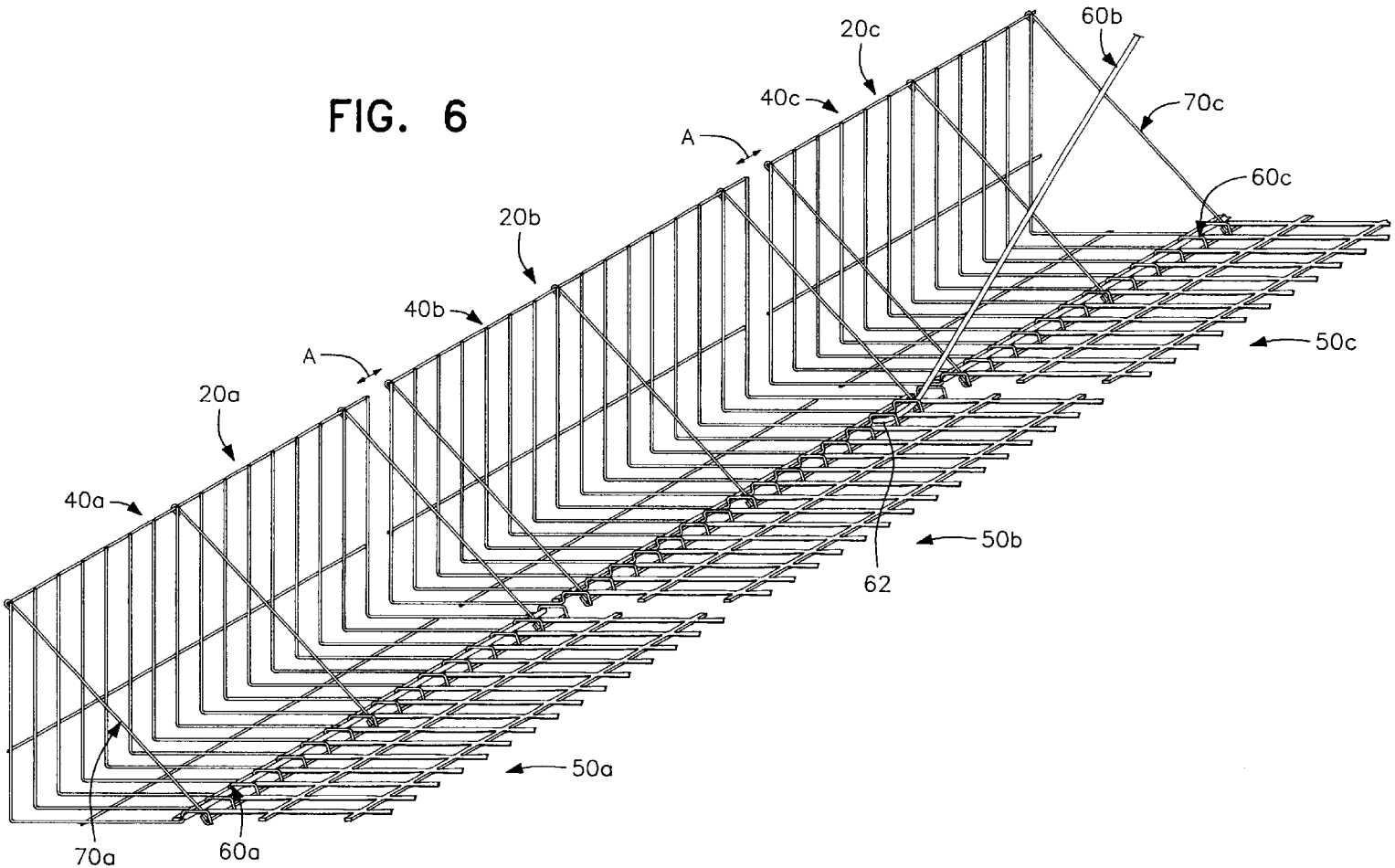
FIG. 6 is a schematic perspective view illustrating the introduction of a flexible or resilient connecting rod into the aligned openings formed by the protuberances in an interior wire facing unit according to an alternative method of constructing a retaining wall by inserting the leading end of the connecting rod between a pair of wires forming the protuberances.

As seen in FIG. 6, a plurality of wire facing units can be arranged side-by-side to form a retaining wall of extended width. Of course, depending on the width of the retaining wall, there can be many wire facing units utilized in the formation of a single wall, only three such facing units 40*a*, 40*b* and 40*c* being shown as illustrative, the outer facing units 40*a* and 40*c* being shown schematically for illustrative clarity. In practice, the side wires 46*a*, 46*b*, 46*c* of each of the wire facing units 40*a*, 40*b*, 40*c* would be positioned next to each other as indicated by the arrows A, but the facing units have been shown as spaced from each other for ease of understanding. In such a construction, inserting a connecting rod through the aligned openings formed by the protuberances at the rear of the floor section of a wire facing unit may be obstructed, particularly in the case of an interior wire facing unit such as shown at 40*b*.

At some sites, the interior wire facing units 40*b* cannot be tilted forwardly to free the ends of the openings 47*b*. A similar problem exists if a geogrid section 50*b* spans more than one wire facing unit 40 (not shown). In such situations, as seen in FIG. 6, the connecting rod 60*b*, while relatively rigid, may be formed of a polymer material such as high density polyethylene, preferably reinforced with fiberglass or the like, to render the same somewhat resilient or flexible so that one end of the connecting rod 60*b*, can be inserted between a pair of wire elements into the openings defined by the protuberances to attach the geogrid to the wire facing unit.

For most applications, the connecting rod 60 can be formed of any material, including metal. However, for use in a situation as discussed with reference to FIG. 6, the connecting rod needs to be sufficiently rigid to enable the same to be pushed through the aligned openings formed by the protuberances, sufficiently flexible to enable it to be inserted at an angle and flexed for use with a partially obstructed wire facing unit, and sufficiently strong to provide a secure connection between the wire facing unit and the geogrid. Those with ordinary skill in this art can readily provide a connecting rod having such characteristics. A preferred material is fiberglass-reinforced, high density polyethylene.

Figure 7:
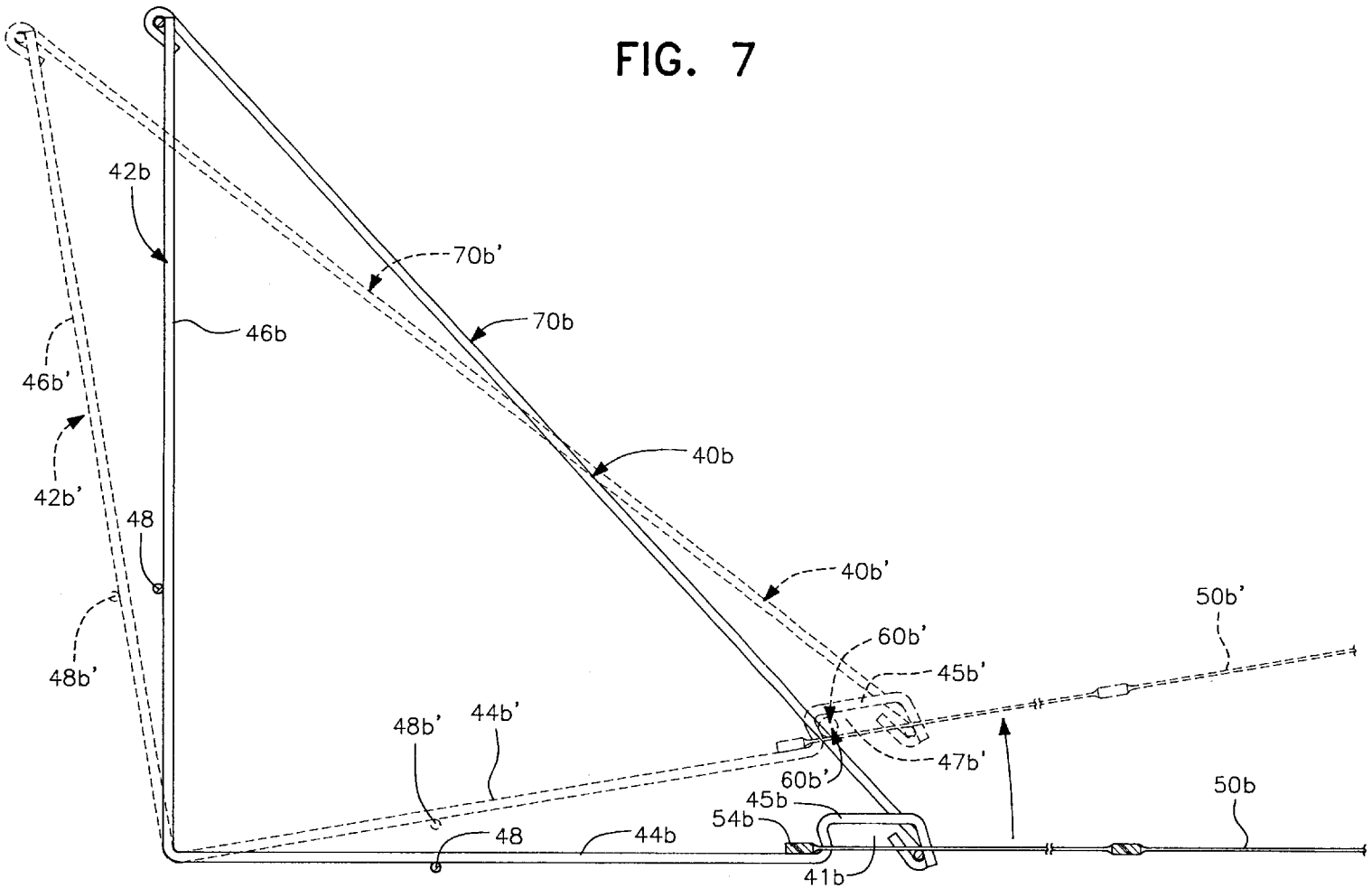
FIG. 7 is a view similar to FIG. 3 showing, in phantom lines, a wire facing unit/geogrid assembly being tilted forwardly to access sides of the facing unit for inserting a connector rod.

If the front of an interior wire facing unit 40*b* is not obstructed and the geogrid section or sections 50*b* to be connected to such an interior facing unit 40*b* are equal to or less than the width of the wire facing unit, the wire facing unit 40*b* can simply be tilted forwardly about its front corner as seen at 40*b*' in phantom lines in FIG. 7 to free the ends of the openings 47*b*' formed by the protuberances 45*b*' and a connecting rod 60*b*', rigid or not, can then be inserted into the openings to secure the geogrid section or sections 50*b*' to the wire facing unit 40*b*'. Then the assembly can be repositioned in lateral contact with juxtaposed wire cages as seen in FIG. 6.

Obviously, the multi-section wall shown in FIGS. 6 and discussed with respect to FIG. 7 can also have multiple tiers such as shown in FIG. 1, and the superimposed tiers can be laterally staggered, if desired, to form a retaining wall of any width and any height with vertically aligned or vertically stepped-back front face sections.

Figure 2:
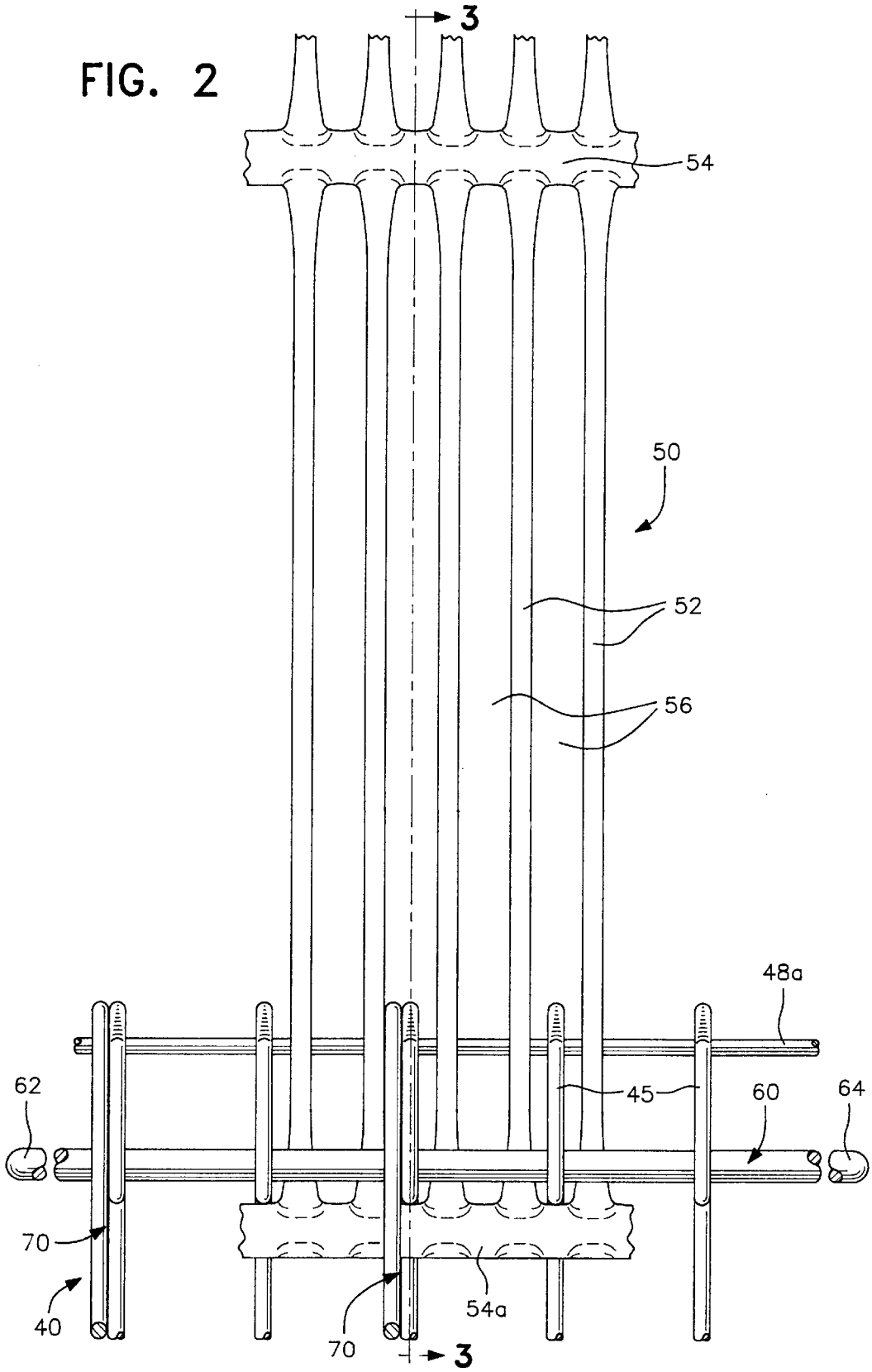
FIG. 2 is a fragmentary enlarged elevational view illustrating the engagement of the front end of a geogrid section with the rear end of the floor section of a wire facing unit, parts being broken away for illustrative clarity and convenience.

Additionally, more than a single strand 52 of a geogrid section 50 can be positioned between adjacent protuberances 45 as seen in FIG. 2, or a protuberance 45 can be provided for each aperture 56 in a geogrid 50 as seen in FIG. 6. Other variations on the spacing are possible without departing from the instant inventive concepts.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A retaining wall system comprising, in combination, an assembly of elements including:

a) at least one wire facing unit including a face section and a floor section extending from one side of said face section, said face section having upper and lower end portions and front and rear faces, and said floor section having front and rear end portions and upper and lower faces, at least the rear end portions of said floor section being formed of a plurality of spaced, generally parallel, longitudinally extending wire elements interconnected by at least one generally transversely extending cross-wire, b) at least one elongated geogrid section having forward end portions and rearward end portions, at least said forward end portions including a plurality of spaced, generally parallel, strand elements interconnected by generally transversely extending cross-bars to define a multiplicity of through-apertures, and c) at least one connecting rod for securing said forward end portions of a geogrid section to rear end portions of a floor section of a wire facing unit, said connecting rod having a transverse cross-section and being elongated, at least some of said longitudinally extending wire elements juxtaposed to said rear end portions of said floor section of said wire facing unit forming upstanding, generally U-shaped protuberances extending from said upper face of said floor section having forward portions inclined forwardly to define a pocket in front of said protuberances, said protuberances being spaced apart by approximately a multiple of the spacing between said apertures defined in said geogrid section, said protuberances defining generally aligned openings extending generally transversely of said floor section of said wire facing unit, and said openings being larger in area than said cross-section of said connecting rod, whereby said elements are adapted to be interconnected to form at least part of a geogrid-reinforced retaining wall by positioning the wire facing unit with the front face of the face section forming a portion of the face of the retaining wall and the floor section extending rearwardly therefrom, positioning the apertures in the forward end portions of the geogrid section over the protuberances in the wire elements at the rear end portions of the floor section of the wire facing unit with one of the cross-bars of the geogrid forwardly of said protuberances seated in the pocket formed by the wire elements and with portions of the geogrid section extending rearwardly from the wire facing unit, inserting the connecting rod through the openings formed by the protuberances to connect the geogrid section to the wire facing unit, and adding aggregate behind the rear face of the face section of the wire facing unit and on top of the upper face of the floor section of the wire facing unit and over the geogrid section.

2. A retaining wall system according to claim 1, wherein said wire facing unit is formed of metal and said face section and said floor section are formed by continuous, longitudinally extending wire elements interconnected by a plurality of spaced transversely extending cross-wires.

3. A retaining wall system according to claim 2, further including at least one strengthening strut for connecting a cross-wire in said upper end portion of said face section with a cross-wire in said rear end portion of said floor section of said wire facing unit.

4. A retaining wall system according to claim 2, wherein said protuberances are formed at the terminal end portions of the floor section of the wire facing unit, and a transversely extending cross-wire interconnects the said longitudinally extending wire elements at the rear end of the floor section.

5. A retaining wall system according to claim 1 wherein said at least one transversely extending cross-wire of said floor section is positioned rearwardly of said protuberances and extends below said longitudinally extending wire elements to underlie the portions of the geogrid section extending rearwardly from the facing unit.

6. A retaining wall system according to claim 1, wherein said geogrid section is a uniaxially stretched integral polymeric geogrid.

7. A retaining wall system according to claim 1, wherein said connecting rod is formed of a fiberglass reinforced polymeric material.

8. A retaining wall system according to claim 1, wherein said connecting rod is resilient to enable a leading end of the connecting rod to be inserted into the openings formed by the protuberances in the wire elements of the rear end portions of the floor section of the wire facing unit between a pair of wire elements forming the protuberances.

9. A retaining wall system according to claim 1, wherein said connecting rod has opposed end portions, and at least one of said end portions is non-flat to facilitate inserting the connecting rod through the openings formed by the protuberances in the wire elements of the rear end portions of the floor section of the wire facing unit.

10. A retaining wall comprising, in combination:

a) at least one wire facing unit including a face section and a floor section extending from one side of said face section, said face section having upper and lower end portions and front and rear faces, and said floor section having front and rear end portions and upper and lower faces, at least the rear end portions of said floor section being formed of a plurality of spaced, generally parallel, longitudinally extending wire elements interconnected by at least one generally transversely extending cross-wire, b) at least one elongated geogrid section having forward end portions and rearward end portions, at least said forward end portions including a plurality of spaced, generally parallel, strand elements interconnected by generally transversely extending cross-bars to define a multiplicity of through-apertures, and c) at least one connecting rod securing said forward end portions of said geogrid section to said rear end portions of said floor section of said wire facing unit, said connecting rod having a transverse cross-section and being elongated, at least some of said longitudinally extending wire elements juxtaposed to said rear end portions of said floor section of said wire facing unit forming upstanding, generally U-shaped protuberances extending from said upper face of said floor section, said protuberances being spaced apart by approximately a multiple of the spacing between said apertures defined in said geogrid section, said protuberances defining generally aligned openings extending generally transversely of said floor section of said wire facing unit, and said openings being larger in area than said cross-section of said connecting rod, said front face of said face section of said wire facing unit forming a portion of the face of said retaining wall and said floor section extending rearwardly therefrom, apertures in forward end portions of a single thickness of said geogrid section being positioned over said protuberances in said wire elements of said rear end portions of said floor section of said wire facing unit with at least one of said cross-bars of said geogrid section forwardly of said protuberances, at least one generally transversely extending cross-wire of said floor section of said wire facing unit underlying said forward end portions of said geogrid section, and portions of said geogrid section extending rearwardly from said wire facing unit, said connecting rod extending through said openings formed by said protuberances to connect said geogrid section to said wire facing unit, and aggregate behind said rear face of said face section of said wire facing unit and on top of said upper face of said floor section of said wire facing unit and over said geogrid section.

11. A retaining wall according to claim 10 comprising at least two superimposed wire facing units, each of which is connected to a geogrid section by a connecting rod.

12. A retaining wall according to claim 11, wherein the front face of the face section of each superior wire facing unit is set back rearwardly from the front face of the face section of an inferior wire facing unit.

13. A retaining wall according to claim 12, wherein said aggregate is soil, further including plant materials planted in the soil of an inferior wire facing unit in front of the front face of a superior wire facing unit.

14. A retaining wall according to claim 10, comprising at least two laterally juxtaposed wire facing units, each of which is connected to a geogrid section by a connecting rod with aggregate behind the rear face of its face section and on top of the upper face of its floor section and its associated geogrid section.

15. A retaining wall according to claim 10, wherein said wire facing unit is formed of metal and said face section and said floor section are formed by continuous longitudinally extending wire elements interconnected by a plurality of spaced transversely extending cross-wires.

16. A retaining wall according to claim 15, further including at least one strengthening strut interconnecting a cross-wire in said upper end portion of said face section with a cross-wire in said rear end portion of said wire facing unit.

17. A retaining wall according to claim 10, wherein the forward portion of the wire elements forming said protuberances are inclined forwardly to define a pocket and said at least one cross-bar of said geogrid section is seated in said pocket.

18. A retaining wall according to claim 10, wherein said geogrid section is a uniaxially stretched integral polymeric geogrid.

19. A retaining wall according to claim 10, wherein said connecting rod is formed of a fiberglass reinforced polymeric material.

20. A retaining wall according to claim 10, wherein said connecting rod is resilient to enable a leading end of the connecting rod to be inserted into the openings formed by the protuberances in the wire elements of the rear end portions of the floor section of the wire facing unit between a pair of the wire elements forming the protuberances.

21. A retaining wall system according to claim 10 wherein said at least one transversely extending cross-wire of said floor section is positioned rearwardly of said protuberances and extends below said longitudinally extending wire elements and underlies said portions of said geogrid section extending rearwardly from said facing unit.

22. A method of forming a retaining wall comprising:

a) providing at least one wire facing unit including a face section and a floor section extending from one side of said face section, said face section having upper and lower end portions and front and rear faces, and said floor section having front and rear end portions and upper and lower faces, at least the rear end portions of said floor section being formed of a plurality of spaced, generally parallel, longitudinally extending wire elements interconnected by at least one generally transversely extending cross-wire, b) providing at least one elongated geogrid section having forward end portions and rearward end portions, at least said forward end portions including a plurality of spaced, generally parallel, strand elements interconnected by generally transversely extending cross-bars to define a multiplicity of through-apertures, and c) providing at least one connecting rod for securing said forward end portions of said geogrid section to said rear end portions of said floor section of said wire facing unit, said connecting rod having a transverse cross-section and being elongated, at least some of said longitudinally extending wire elements juxtaposed to said rear end portions of said floor section of said wire facing unit forming upstanding, generally U-shaped protuberances extending from said upper face of said floor section, said protuberances being spaced apart by approximately a multiple of the spacing between said apertures defined in said geogrid section, said protuberances defining generally aligned openings extending generally transversely of said floor section of said wire facing unit, and said openings being larger in area than said cross-section of said connecting rod, positioning said wire facing unit with said front face of said face section forming a portion of the face of said retaining wall and said floor section extending rearwardly therefrom, positioning apertures in forward end portions of a single thickness of said geogrid section over said protuberances in said wire elements at said rear end portions of said floor section of said wire facing unit with at least one of said cross-bars of said geogrid section forwardly of said protuberances, at least one generally transversely extending cross-wire of said floor section of said wire facing unit underlying said forward end portions of said geogrid section, and portions of said geogrid section extending rearwardly from said wire facing unit, inserting said connecting rod through said openings formed by said protuberances to connect said geogrid section to said wire facing unit, and placing aggregate behind said rear face of said face section of said wire facing unit and on top of said upper face of said floor section of said wire facing unit and over said geogrid section.

23. A method according to claim 22 wherein said at least one transversely extending cross-wire of said floor section is positioned rearwardly of said protuberances and extends below said longitudinally extending wire elements to underlie the portions of the geogrid section extending rearwardly from the facing unit.

24. A method according to claim 22, wherein said wire facing unit is formed of metal and said face section and said floor section are formed by continuous longitudinally extending wire elements interconnected by a plurality of spaced transversely extending cross-wires.

25. A method according to claim 24, wherein the forward portion of the wire elements forming said protuberances are inclined forwardly to define a pocket, and a cross-bar at the forward end of said geogrid section is positioned in said pocket.

26. A method according to claim 24, further including providing at least one strengthening strut, and connecting one end of said strengthening strut to a cross-wire in said upper end portion of said face section and the other end of said strengthening strut to a cross-wire in said rear end portion of said wire facing unit.

27. A method according to claim 22, wherein said geogrid section is a uniaxially stretched integral polymeric geogrid.

28. A method according to claim 22, wherein said connecting rod is formed of a fiberglass reinforced polymeric material.

29. A method according to claim 22, wherein said connecting rod is resilient and, at least in some facing unit sections, a leading end of said connecting rod is inserted into the openings formed by the protuberances in the wire elements at the rear end portions of the floor section of the wire facing unit from between a pair of the wire elements forming the protuberances.

30. A method according to claim 22, comprising constructing at least three laterally juxtaposed geogrid-reinforced retaining wall portions from at least one interior wire facing unit and a pair of end wire facing units, said connecting rod being resilient and, at least in the interior wire facing unit, the connecting rod is inserted through the openings formed by the protuberances in the wire elements at the rear end portions of the floor section between a pair of wire elements forming the protuberances.

31. A method according to claim 22, wherein said connecting rod has opposed end portions, and at least one of said end portions is non-flat to facilitate inserting the connecting rod through the openings formed by the protuberances in the wire elements of the rear end portions of the floor section of the wire facing unit with said non-flat end portion first.

32. A method according to claim 22, further comprising superimposing at least one further wire facing unit on the geogrid-reinforced retaining wall section initially formed, connecting a further geogrid section to the further wire facing unit by, a further connecting rod, and placing aggregate on the further wire facing unit and the further geogrid section to increase the height of the retaining wall.

33. A method according to claim 32, comprising setting back the front face of the face section of each superior wire facing unit rearwardly from the front face section of an inferior wire facing unit.

34. A retaining wall comprising, in combination:

a) at least one wire facing unit including a face section and a floor section extending from one side of said face section, said face section having upper and lower end portions and front and rear faces, and said floor section having front and rear end portions and upper and lower faces, at least the rear end portions of said floor section being formed of a plurality of spaced, generally parallel, longitudinally extending wire elements interconnected by at least one generally transversely extending cross-wire, b) at least one elongated geogrid section having forward end portions and rearward end portions, at least said forward end portions including a plurality of spaced, generally parallel, strand elements interconnected by generally transversely extending cross-bars to define a multiplicity of through-apertures, and c) at least one connecting rod securing said forward end portions of said geogrid section to said rear end portions of said floor section of said wire facing unit, said connecting rod having a transverse cross-section and being elongated, at least some of said longitudinally extending wire elements juxtaposed to said rear end portions of said floor section of said wire facing unit forming upstanding, generally U-shaped protuberances extending from said upper face of said floor section having forward end portions inclined forwardly to define a pocket in front of said protuberances, said protuberances being spaced apart by approximately a multiple of the spacing between said apertures defined in said geogrid section, said protuberances defining generally aligned openings extending generally transversely of said floor section of said wire facing unit, and said openings being larger in area than said cross-section of said connecting rod, said front face of said face section of said wire facing unit forming a portion of the face of said retaining wall and said floor section extending rearwardly therefrom, apertures in forward end portions of said geogrid section being positioned over said protuberances in said wire elements of said rear end portions of said floor section of said wire facing unit with at least one of said cross-bars of said geogrid section forwardly of said protuberances seated in said pockets, at least one generally transversely extending cross-wire of said floor section of said wire facing unit underlying said forward end portions of said geogrid section, and portions of said geogrid section extending rearwardly from said wire facing unit, said connecting rod extending through said openings formed by said protuberances to connect said geogrid section to said wire facing unit, and aggregate behind said rear face of said face section of said wire facing unit and on top of said upper face of said floor section of said wire facing unit and over said geogrid section.

35. A retaining wall according to claim 34, wherein said wire facing unit is formed of metal and said face section and said floor section are formed by continuous longitudinally extending wire elements interconnected by a plurality of spaced transversely extending cross-wires.

36. A retaining wall according to claim 34, wherein said geogrid section is a uniaxially stretched integral polymeric geogrid.

37. A retaining wall according to claim 34 wherein said at least one transversely extending cross-wire of said floor section is positioned rearwardly of said protuberances and extends below said longitudinally extending wire elements and underlies said portions of said geogrid section extending rearwardly from said facing unit.

38. A method of forming a retaining wall comprising:

a) providing at least one wire facing unit including a face section and a floor section extending from one side of said face section, said face section having upper and lower end portions and front and rear faces, and said floor section having front and rear end portions and upper and lower faces, at least the rear end portions of said floor section being formed of a plurality of spaced, generally parallel, longitudinally extending wire elements interconnected by at least one generally transversely extending cross-wire, b) providing at least one elongated geogrid section having forward end portions and rearward end portions, at least said forward end portions including a plurality of spaced, generally parallel, strand elements interconnected by generally transversely extending cross-bars to define a multiplicity of through-apertures, and c) providing at least one connecting rod for securing said forward end portions of said geogrid section to said rear end portions of said floor section of said wire facing unit, said connecting rod having a transverse cross-section and being elongated, at least some of said longitudinally extending wire elements juxtaposed to said rear end portions of said floor section of said wire facing unit forming upstanding, generally U-shaped protuberances extending from said upper face of said floor section having forward end portions inclined forwardly to define a pocket in front of said protuberances, said protuberances being spaced apart by approximately a multiple of the spacing between said apertures defined in said geogrid section, said protuberances defining generally aligned openings extending generally transversely of said floor section of said wire facing unit, and said openings being larger in area than said cross-section of said connecting rod, positioning said wire facing unit with said front face of said face section forming a portion of the face of said retaining wall and said floor section extending rearwardly therefrom, positioning apertures in forward end portions of said geogrid section over said protuberances in said wire elements at said rear end portions of said floor section of said wire facing unit with at least one of said cross-bars of said geogrid section forwardly of said protuberances seated in said pockets, at least one generally transversely extending cross-wire of said floor section of said wire facing unit underlying said forward end portions of said geogrid section, and portions of said geogrid section extending rearwardly from said wire facing unit, inserting said connecting rod through said openings formed by said protuberances to connect said geogrid section to said wire facing unit, and placing aggregate behind said rear face of said face section of said wire facing unit and on top of said upper face of said floor section of said wire facing unit and over said geogrid section.

39. A method according to claim 38, wherein said wire facing unit is formed of metal and said face section and said floor section are formed by continuous longitudinally extending wire elements interconnected by a plurality of spaced transversely extending cross-wires.

40. A method according to claim 38, wherein said geogrid section is a uniaxially stretched integral polymeric geogrid.

41. A method according to claim 38, wherein said at least one transversely extending cross-wire of said floor section is positioned rearwardly of said protuberances and extends below said longitudinally extending wire elements to underlie the portions of the geogrid section extending rearwardly from the facing unit.

* * * * *